US005702057A

United States Patent [19]

Huber

[11] Patent Number: 5,702,057

[45] Date of Patent: Dec. 30, 1997

[54] SHOWER HEAD, PARTICULARLY FOR A HAND SHOWER

[75] Inventor: Roland Huber, Hendschiken, Switzerland

[73] Assignee: Hansa Metallwerke AG, Stuttgart, Germany

[21] Appl. No.: 576,432

[22] Filed: Dec. 19, 1995

[30] Foreign Application Priority Data

Dec. 29, 1994 [DE] Germany ..... 44 47 115.1

[51] Int. Cl.[6] ..... B05B 1/00

[52] U.S. Cl. ..... 239/288.3; 239/533.12; 239/602

[58] Field of Search ..... 239/288, 288.3, 239/288.5, 447, 449, 525, 533.13, 588, 602, DIG. 12

[56] References Cited

U.S. PATENT DOCUMENTS 2,402,741 6/1946 Draviner ..... 239/DIG. 12
4,629,124 12/1986 Gruber ..... 239/447 X
5,172,862 12/1992 Heimann et al. ..... 239/602 X
5,228,625 7/1993 Grassberger ..... 239/587.1 X
5,405,089 4/1995 Heimann et al. ..... 239/DIG. 12 X

*Primary Examiner*—Andres Kashnikow
*Assistant Examiner*—Steven J. Ganey
*Attorney, Agent, or Firm*—Lowe, Price, LeBlanc & Becker

[57] ABSTRACT

The shower base (1) of a shower head consists of a rigid perforated plate (1*a*), which has a number of holes (4, 5). Set inside each of the holes (4, 5) in the perforated plate (1*a*) is a hose-type jet insert (6, 8) made of a flexible material which, owing to its material properties, can be automatically flexed to dislodge limescale deposits. The shower base (1) is sealed against the rest of the shower head, in particular against its housing (2) by means of one or more seals (25, 29). This/these seal(s) (25, 29) is/are made of the same material as the jet inserts (6, 8) and is/are manufactured jointly with these, for preference connected in one piece. In this way, it is not necessary for the seals (25, 29) to be manufactured, kept in store and assembled separately.

5 Claims, 1 Drawing Sheet

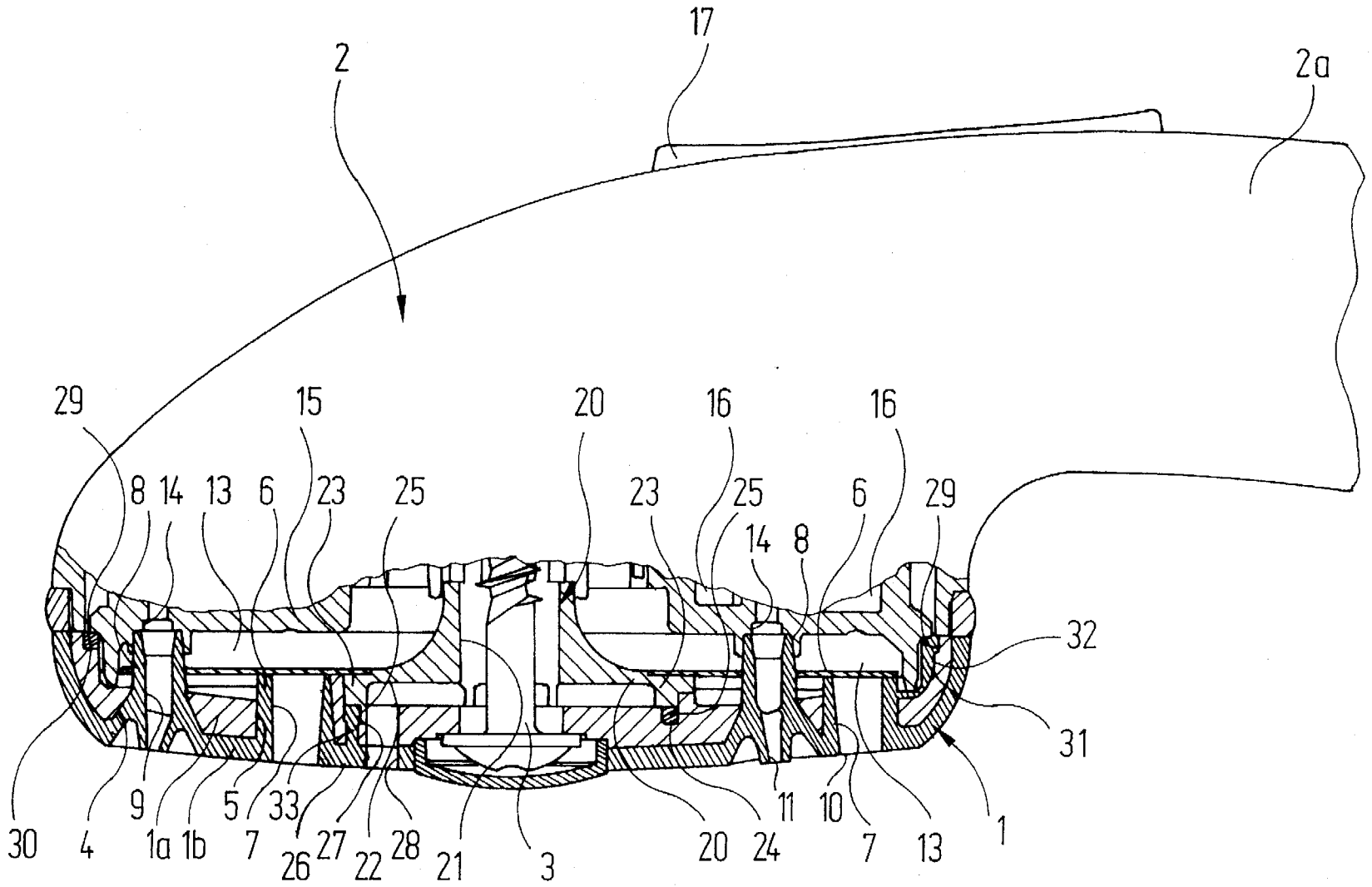
2a
17
2
29
8
14
13
6
23
15
25
16
20
23
16
6
8
14
25
29
32
31
1
13
7
10
11
24
20
3
21
28
22
27
26
33
7
5
1b
1a
9
4
30

SHOWER HEAD, PARTICULARLY FOR A HAND SHOWER

FIELD OF THE INVENTION

The invention concerns a shower head, particularly for a hand shower, which includes an essentially bell-shaped housing in which at least one water chamber is formed which can be connected to a water supply channel, and a shower base, which seals the bell-shaped housing at the bottom and consists of a perforated plate made of a rigid material which has a number of holes, and a number of hose-type jet inserts, which are made of a relatively soft, flexible material, each of which have a jet channel terminating in a water outlet opening passing through them and each of which passes through a hole in the perforated plate, and includes one or more seals which seals(s) the shower base against the housing and/or one or more insert(s) set in the housing.

BACKGROUND OF THE RELATED ART

It is known that the water outlet openings in shower bases have a tendency to fur up over the useful life of the shower head. This is manifested at first by a jet pattern, the geometry of which differs from that of the pattern in its state as new and also by a lower output per liter delivered. Limescale can build up until finally the water outlet openings are completely blocked.

For this reason it is known, for example as described in DE-GM 90 17 978, that water outlet openings are made in hose-type jet attachments made of a soft, flexible material. These can be automatically flexed by stroking the hand over them so that the limescale deposited on the shell surfaces of the jet channels, particularly in the area around the water outlet openings, is dislodged. The through-flow of water through the water outlet openings in the shower base is then once again free running.

The seal between the shower base and the bell-shaped housing is made in these cases by O-ring seals which are manufactured and assembled as separate parts. Consequently, the manufacture, storage and assembly of these separate seals incur costs.

SUMMARY OF THE INVENTION

The task of this invention is to design a shower head of the type described at the beginning to keep the costs associated with the seals, which are needed to seal the shower base against the rest of the shower head, as low as possible.

This problem is solved by the invention in which d) the seal(s) is/are manufactured jointly with the jet inserts and is (are) made of the same material as these.

According to the invention, therefore, the seals with which the shower base is sealed against the rest of the shower head are not separate (supply) parts which are manufactured independently of the shower base, stored and then inserted between shower base and housing on final assembly of the shower head. Instead, the seals are manufactured at the same time as the shower base, almost cost-free as it were, as a result of which they are already in place in their final assembly position and therefore no longer require separate storage and assembly. This eliminates many of the processing steps which were still necessary in the state of the art associated with these seals.

From an engineering and manufacturing aspect, the configuration of the invention in which the seals are connected to the jet inserts to form one piece is particularly convenient.

DETAILED DESCRIPTION OF THE PREFERRED EMBODIMENTS

In a preferred embodiment, the one piece design is produced by connecting at least one seal to at least one jet insert by means of at least one material lug which extends along the inner surface of the perforated plate. The material lug can thereby be set in a groove moulded in the inside surface of the perforated plate.

In a very advantageous embodiment of the invention, the jet inserts are formed in one piece with an impact protection plate, which essentially covers the entire outer surface of the perforated plate and is made of the same material as the jet inserts. This impact protection plate, as the name implies, forms an impact protection for the outer surface of the perforated plate, which is, in itself, actually made of a rigid material and is therefore not in itself impact resistant. Also, due to the fact that this impact protection plate is manufactured together with the jet inserts, it can be produced without incurring any appreciable extra costs.

If this type of impact protection plate is used, then a configuration of the invention is advantageous in which the seal is connected to the impact protection plate via at least one material lug which extends through a hole in the perforated plate. The impact protection plate, which is actually mounted on the side of the perforated plate facing the seal, can easily be reached at all times through the connecting hole in the perforated plate, virtually irrespective of the respective position of the seal.

Shower bases are generally circular in form, which is why the seal between the shower base and the rest of the shower head in general also has the form of a ring seal. In these cases, it is advisable to fit several material lugs spaced over the circumference of the seal. This plurality of material lugs ensures an excellent flow of material when injection moulding the jet inserts, the impact protection plate and the seals. They also provide an excellent cohesion of the various components of the shower base, including the seal(s), even if the soft, flexible material has not been injection moulded on to the rigid perforated plate using the two-component technique, and therefore for this reason already secured to the rigid perforated plate.

Of course irrespective of this, however, the injection moulding of all flexible components on to the rigid perforated plate using the well-known two-component technique is possible and also advantageous within the framework of the invention.

One embodiment of the invention is explained in greater detail below with the aid of the drawing; the single figure shows a (partial) side view of a shower head, partly in section.

The shower head illustrated comprises on the whole in the known manner, a bell-shaped housing 2, the bottom, open end of which is sealed by a multi-part shower base 1. The shower base 1 is attached to the components of the shower head housed inside the housing by means of a central screw 3 in such a way that it can be removed. The process does not require more detailed explanation.

The shower base 1 for its part consists of a perforated plate 1*a* made of a relatively rigid synthetic material, the outer surface of which, i.e. on the surface pointing downwards in the drawing, is covered by an impact protection plate 1*b* made of a relatively soft, flexible material. The impact protection plate 1*b* can also, like all the components which are yet to be described and which are made of the same relatively soft, flexible material, be injection moulded on to the perforated plate using the two-component technique. The impact protection plate 1*b* essentially covers the entire outer surface of the perforated plate 1*a*.

The perforated plate 1*a* on the shower base 1 has, on the whole in the known manner, several sets of holes 4, 5, which are arranged in concentric circles evenly spaced around the central axis of the shower base 1. In this context, it is not important to have an exact hole pattern formed by the holes 4,5 in the perforated plate.

The rather larger diameter holes 5 in the perforated plate 1*a* each have a hose-type jet insert 6 going through them which has a relatively small axial length, i.e. extend only slightly beyond the top side of the perforated plate 1*a* (facing inside the housing 2 of the shower head). Each of the hose-type jet inserts 6 have a jet channel 7 of relatively large cross-section going axially through them, which tapers conically towards the outside in the embodiment illustrated. The hose-type jet inserts 6 are furthermore preformed in one piece on to the impact protection plate 1*b* and are made of the same material as this.

In addition, each of the holes 4 in the perforated plate 1*a* have hose-type jet inserts 8 going through them, which form a single piece with the impact protection plate 1*b*, but which have a greater axial length than the jet inserts 6, i.e. they extend further beyond the inside of the perforated plate. Each of the hose-type jet inserts 8 also have jet channels 9 passing through them, which have a small cross-section in comparison with the jet channels 7 of the jet inserts 6. Each of the jet channels 9 also tapers from inside outwards.

The outer end of the jet inserts 6 has a special form which enables the user to flex it automatically by brushing the hand over it in order to dislodge limescale deposits from the jet channels 9, especially around the water outlet openings 11. This form is of minor importance in this context and will therefore not be described in greater detail.

If, as shown in the drawing, the shower base 1 is mounted on the housing 2 of the shower head, the axially shorter hose-type jet inserts 6 protrude in to a first water chamber 13 formed inside the housing 2. The axially inner ends of the axially longer hose-type jet inserts 8, however, are contained in holes 14 in an inner dividing wall 15, which is part of an insert 20 and separates the first water chamber 13 inside the housing 2 from a second water chamber 16 which has a greater distance from the shower head 1.

In addition, the insert 20 has a centre hole 21, which runs coaxially to the central fixing screw 3 in the direction of the shower base 1. In the vicinity of the shower base 1, the centre hole 21 is extended by an extension 22 which is bordered at its circular outer circumference by a ring-shaped collar 23. The ring-shaped front face of the collar 23 rests against the top of the perforated plate 1*a*. Housed in a groove 24 on the top of the perforated plate is a ring seal 25 which prevents the passage of air and/or water through the gap between the collar 23 and the perforated plate 1*a*. The groove 24 in the perforated plate 1*a* is connected to the outer surface of the perforated plate 1*a* by means of several, relatively small diameter holes, which are spaced concentrically around the circumference. The ring seal 25 is made of the same material as the impact protection plate 1*b* and the jet inserts 6 and 8. It is connected in one piece to the impact protection plate via the material lugs 33 which go through the holes 26 in the perforated plate 1*a*.

On a circle with a radius which is smaller than the radius of the circular collar 23 on the insert 20, the perforated plate is provided with several holes 27 spaced over its circumference which extend axially into corresponding holes 28 in the impact protection plate 1*b*. Only one of these holes 27 or 28 can be seen in the drawing.

A second ring-shaped seal 29, which is also made of the same material as the impact protection plate 1*b* and the jet inserts 6 and 8 lies in a step 30 which has been made on the inside of the perforated plate 1*a* in its radially most extreme area. The ring seal 29 is connected in one piece to the adjoining jet inserts 6 or 8 via several material lugs 31 spaced over the circumference of the shower base. The ring seal 29 seals three parts from each other: the perforated plate 1*a*, the insert 20 and also the housing 2 of the shower head.

As a result of the one-piece connection of all the parts made of the same flexible material, i.e. especially as a result of the connection between the ring seals 25, 29 and the jet inserts 6, 8 and the impact plate 1*b*, it is possible to manufacture the seals required to seal the shower base 1 to the rest of the shower head at the same time as the shower base 1 itself, without any special operating process, and locate them in the correct position.

The shower head described operates as follows:

The water flowing in the known manner through the handle 2*a* of the shower head is conveyed as required to the first water chamber 13 or the second water chamber 16 by means of a change-over mechanism, which is operated by means of a rocker-type actuating device 17.

If the position of the change-over mechanism is such that the water flows into the first water chamber 13, then from there it is able to flow out of the hose-type jet inserts 6 and their outlet openings via the jet channels 7. As a result of the relatively large diameter of the outlet openings 10, the jets of water issuing from them are relatively slow and have a large diameter, which are known as "soft jets". Furthermore, these jets of water are mixed with air, in a manner which will not be described in greater detail here, which is taken in via the holes 27, 28 in the shower base 1 and the centre hole of the insert 20.

If, by means of the rocker-type actuating device 17, the change-over mechanism is actuated so that the water flowing via the handle 2*a* reaches the second water chamber 16, then this water overflows in to the hose-type jet inserts 8 in the shower base 1 via the holes 14 in the dividing wall. The relatively narrow jet channels 9 in the hose-type jet inserts 8, and especially at the ends which taper conically at the outlet opening 11, cause the water to accelerate considerably; it comes out of the openings 11 at high speed in the form of a relatively narrow jet. These jets of water are therefore also called "hard jets".

Although the present invention has been described and illustrated in detail, it should be clearly understood that the same is by way of illustration and example only and is not to be taken by way of limitation, the spirit and scope of the present invention being limited only by the terms of the appended claims.

I claim:

1. A shower head, comprising:

a) an essentially bell-shaped housing in which at least one water chamber is formed which can be linked with a water supply channel;

b) a shower base, which seals a bottom of the bell-shaped housing and consists of (ba) a perforated plate made of a rigid material which has a number of holes, (bc) a number of hose-type jet inserts which are made of a relatively soft, flexible material, each of which have a jet channel terminating in a water outlet opening passing through them and each of which passes through a hole in the perforated plate; and (c) at least one seal which seals the shower base against the housing, and at least one jet insert set in the housing, wherein the at least one seal is manufactured jointly with the at least one jet insert and is made of the same material, wherein the at least one seal is joined to a corresponding jet insert to form a single component, and wherein the at least one seal is connected to the corresponding jet insert by at least one lug which extends along an inner surface of the perforated plate.

2. The shower head according to claim 1, wherein:

the lug is set in a groove molded in the inner surface of the perforated plate.

3. The shower head according to claim 1, wherein:

the at least one jet insert is formed in one piece with an impact protection plate which essentially covers the entire outer surface of the perforated plate and is made of the same material as the at least one jet insert.

4. The shower head according to claim 3, wherein:

the at least one seal is connected to the impact protection plate by at least one lug which extends through a hole in the perforated plate.

5. The shower head according to claim 1, wherein:

the at least one seal has the form of a ring seal and several lugs are provided which are spaced around a circumference of the seal.

* * * * *